US010804656B2

(12) United States Patent
Oosaka et al.

(10) Patent No.: US 10,804,656 B2
(45) Date of Patent: Oct. 13, 2020

(54) CONNECTOR CONNECTABLE TO DIFFERENT CABLE TYPES, AND CABLE HARNESS INCLUDING THE CONNECTOR

(71) Applicants: JAPAN AVIATION ELECTRONICS INDUSTRY, LIMITED, Shibuya-ku, Tokyo (JP); JAE TAIWAN, LTD., Taichung (TW)

(72) Inventors: Junji Oosaka, Tokyo (JP); Masayuki Katayanagi, Taichung (TW)

(73) Assignees: JAPAN AVIATION ELECTRONICS INDUSTRY, LIMITED, Tokyo (JP); JAE TAIWAN, LTD., Taichung (TW)

( * ) Notice: Subject to any disclaimer, the term of this patent is extended or adjusted under 35 U.S.C. 154(b) by 0 days.

(21) Appl. No.: 16/173,862

(22) Filed: Oct. 29, 2018

(65) Prior Publication Data

US 2019/0173237 A1 Jun. 6, 2019

(30) Foreign Application Priority Data

Dec. 6, 2017 (JP) ..... 2017-234122

(51) Int. Cl.
*H01R 13/6593* (2011.01)
*H01R 9/05* (2006.01)
(Continued)

(52) U.S. Cl.
CPC ..... *H01R 13/6593* (2013.01); *H01R 9/0503* (2013.01); *H01R 9/0512* (2013.01);
(Continued)

(58) Field of Classification Search
CPC ..... H01R 13/6461; H01R 3/6471; H01R 13/6474; Y01S 439/941
See application file for complete search history.

(56) References Cited

U.S. PATENT DOCUMENTS 5,938,479 A * 8/1999 Paulson ..... H01R 4/2433 439/676
6,120,329 A * 9/2000 Steinman ..... H01R 13/6461 439/676
(Continued)

FOREIGN PATENT DOCUMENTS

CN 101841107 A 9/2010
CN 102769234 A 11/2012
(Continued)

OTHER PUBLICATIONS

Taiwanese Office Action (and English language translation thereof) dated Mar. 7, 2019 issued in counterpart Taiwanese Application No. 107137327.
(Continued)

*Primary Examiner* — Tho D Ta
(74) *Attorney, Agent, or Firm* — Holtz, Holtz & Volek PC

(57) ABSTRACT

A connector has first group terminals and second group terminals. Each of the first group terminals is provided with one first contact portion and at least one first wire connection portion. The first contact portion is located forward of the first wire connection portion. Each of the second group terminals is provided with one second contact portion and one second wire connection portion. The second contact portion is located forward of the second wire connection portion. The first contact portion and the second contact portion are arranged in a pitch direction. In the pitch direction, between adjacent two of the first contact portions, at least two of the second contact portions are located. The first wire connection portion is located at a position different from a position of the second wire connection portion in the front-rear direction and in the up-down direction.

12 Claims, 16 Drawing Sheets

(51) Int. Cl.

| | |
|---|---|
| ***H01R 13/26*** | (2006.01) |
| ***H01R 13/6585*** | (2011.01) |
| *H01R 107/00* | (2006.01) |
| *H01R 24/60* | (2011.01) |
| *H01R 13/6461* | (2011.01) |
| *H01R 13/6474* | (2011.01) |
| *H01R 13/6471* | (2011.01) |

(52) U.S. Cl.
CPC ..... *H01R 13/26* (2013.01); *H01R 13/6585* (2013.01); *H01R 9/0506* (2013.01); *H01R 13/6461* (2013.01); *H01R 13/6471* (2013.01); *H01R 13/6474* (2013.01); *H01R 24/60* (2013.01); *H01R 2107/00* (2013.01); *Y10S 439/941* (2013.01)

(56) References Cited

U.S. PATENT DOCUMENTS

| | | | | |
|---|---|---|---|---|
| 6,183,306 | B1 * | 2/2001 | Caveney ..... | H01R 13/6461 439/676 |
| 7,906,730 | B2 | 3/2011 | Atkinson et al. | |
| 9,093,792 | B2 | 7/2015 | Shiratori et al. | |
| 9,413,091 | B2 | 8/2016 | Wu et al. | |
| 9,685,739 | B2 * | 6/2017 | Chen ..... | H01R 13/6585 |
| 10,084,244 | B1 | 9/2018 | Chang | |
| 2010/0081302 | A1 | 4/2010 | Atkinson et al. | |
| 2014/0235108 | A1 | 8/2014 | Shiratori et al. | |
| 2019/0131748 | A1 * | 5/2019 | Cheng ..... | H01R 13/6597 |

FOREIGN PATENT DOCUMENTS

| | | | |
|---|---|---|---|
| CN | 103996933 | A | 8/2014 |
| CN | 104882696 | A | 9/2015 |
| CN | 105337066 | A | 2/2016 |
| CN | 205543504 | U | 8/2016 |
| CN | 206595442 | U | 10/2017 |
| CN | 107317122 | A | 11/2017 |
| JP | 2005071668 | A | 3/2005 |
| TW | M461204 | U | 9/2013 |
| TW | M468064 | U | 12/2013 |
| TW | M548382 | U | 9/2017 |
| WO | 2016188445 | A1 | 12/2016 |

OTHER PUBLICATIONS

Chinese Office Action (and English translation thereof) dated Mar. 19, 2020, issued in counterpart Chinese Application No. 201811282628.X.

* cited by examiner

CONNECTOR CONNECTABLE TO DIFFERENT CABLE TYPES, AND CABLE HARNESS INCLUDING THE CONNECTOR

CROSS REFERENCE TO RELATED APPLICATIONS

This application is based on and claims priority under 35 U.S.C. § 119 to Japanese Patent Application No. JP2017-234122 filed Dec. 6, 2017, the contents of which are incorporated herein in their entirety by reference.

BACKGROUND OF THE INVENTION

This invention relates to a connector and a cable harness which is provided with a connector.

CN205543504 U (Patent Document 1) discloses a connector to which a plurality of cables having different thickness are connected. As shown in FIG. 21, cables 92 connected to a connector 90 disclosed in Patent Document 1 are arranged in two rows; upper and lower rows. In each row, the cables 92 are fixed to one another by a metal clip 94. The cables 92 in each row include thin signal lines 921 and thick power supply lines 923.

SUMMARY OF THE INVENTION

There is a case where external diameters of cables for connecting a connector and a circuit board to each other are restricted depending on an arrangement pitch of connection pads formed on the circuit board. Under such size restriction, it is hard to employ cables having a large external diameter as power supply lines to ensure large current capacity. Therefore, in order to ensure large current capacity in each of the power supply lines even under the size restriction, it has been carried out that thin coaxial cables are used for signal lines while discrete lines are used for the power supply lines. In other words, there is technique using different type cables for the signal line and the power supply line.

However, the connector described in Patent Document 1 has a problem that it is difficult to connect mixed cables of different types thereto.

It is therefore an object of the present invention to provide a connector having a structure connectable to different type cables.

One aspect of the present invention provides a connector mateable with a mating connector along a front-rear direction. The connector comprises a plurality of first group terminals, a plurality of second group terminals and a holding member holding the first group terminals and the second group terminals. Each of the first group terminals comprises one first contact portion and at least one first wire connection portion. The first contact portion is contactable with a mating terminal when the connector and the mating connector are mated with each other. The first wire connection portion is connectable to a cable. The first contact portion is located forward of the first wire connection portion in the front-rear direction. Each of the second group terminals comprises one second contact portion and one second wire connection portion. The second contact portion is contactable with a mating terminal when the connector and the mating connector are mated with each other. The second wire connection portion is connectable to another cable. The second contact portion is located forward of the second wire connection portion in the front-rear direction. The first contact portions and the second contact portions are arranged in a pitch direction perpendicular to the front-rear direction. Two or more of the second contact portions are located between adjacent two of the first contact portions in the pitch direction. The first wire connection portion is located at a position different from a position of the second wire connection portion in the front-rear direction and in an up-down direction perpendicular to both of the front-rear direction and the pitch direction.

In the connector according to one aspect of the present invention, the first wire connection portion of the first group terminal is located in the position different from the position of the second wire connection portion of the second group terminal in the front-rear direction and in the up-down direction. Thus, the position of the first wire connection portion and the position of the second wire connection portion are different from each other. Accordingly, connection of the cable to the first wire connection portion and connection of the other cable to the second wire connection portion can be carried out separately. Therefore, it is easy to connect different type cables to the first wire connection portion and the second wire connection portion, respectively.

An appreciation of the objectives of the present invention and a more complete understanding of its structure may be had by studying the following description of the preferred embodiment and by referring to the accompanying drawings.

Figure 1:
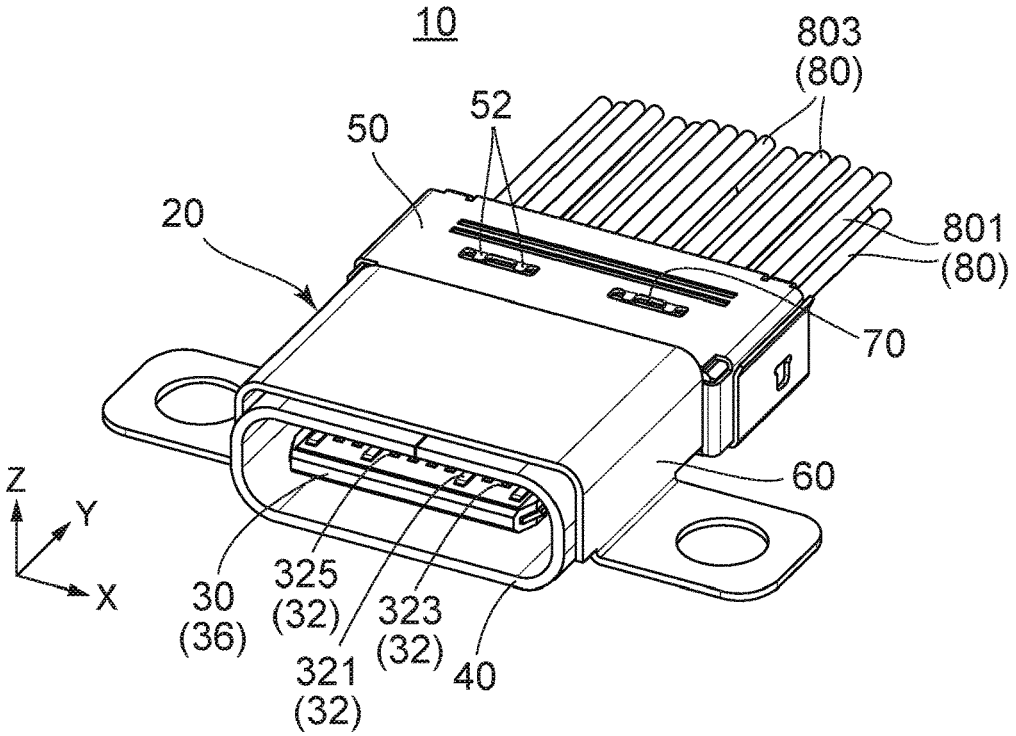
FIG. 1 is a perspective view showing a cable harness according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
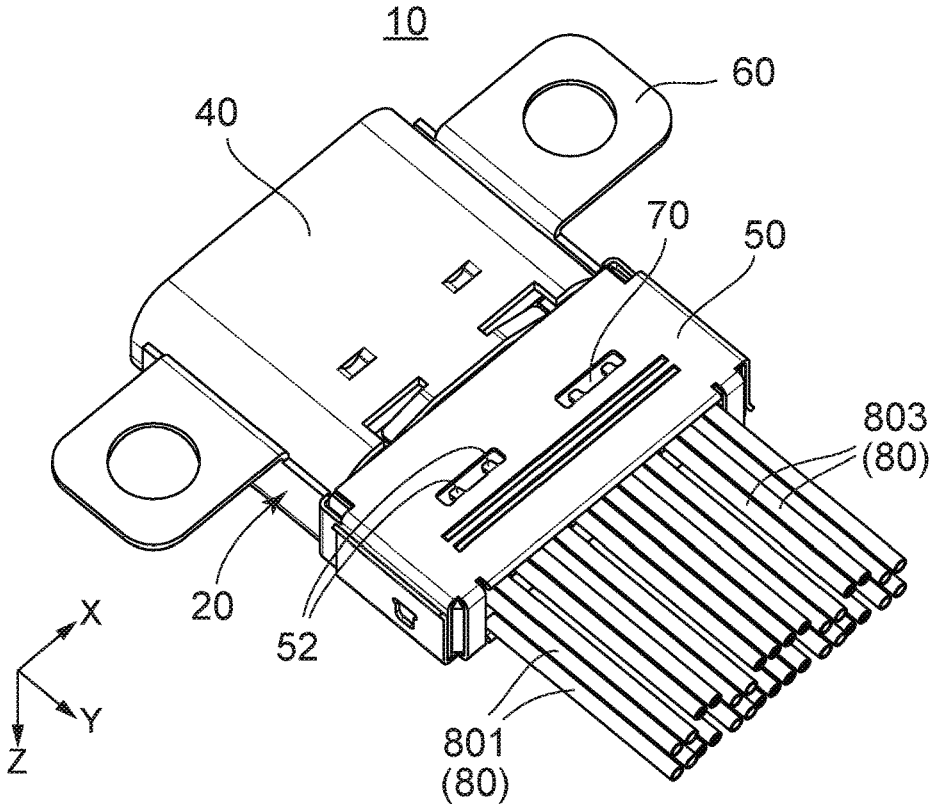
FIG. 2 is another perspective view showing the cable harness of FIG. 1.

Referring to FIGS. 1 and 2, a cable harness 10 according to a first embodiment of the present invention has a connector 20 and a plurality of cables 80. In the present embodiment, the connector 20 is a connector mateable with and detachable from a mating connector (not shown) along a front-rear direction, wherein the mating connector is provided with a plurality of terminals (not shown). In the present embodiment, the front-rear direction is a Y-direction. A negative Y-direction is directed forward while a positive Y-direction is directed rearward. Moreover, in the present embodiment, the connector 20 is a receptacle connector while the mating connector is a plug connector.

Figure 3:
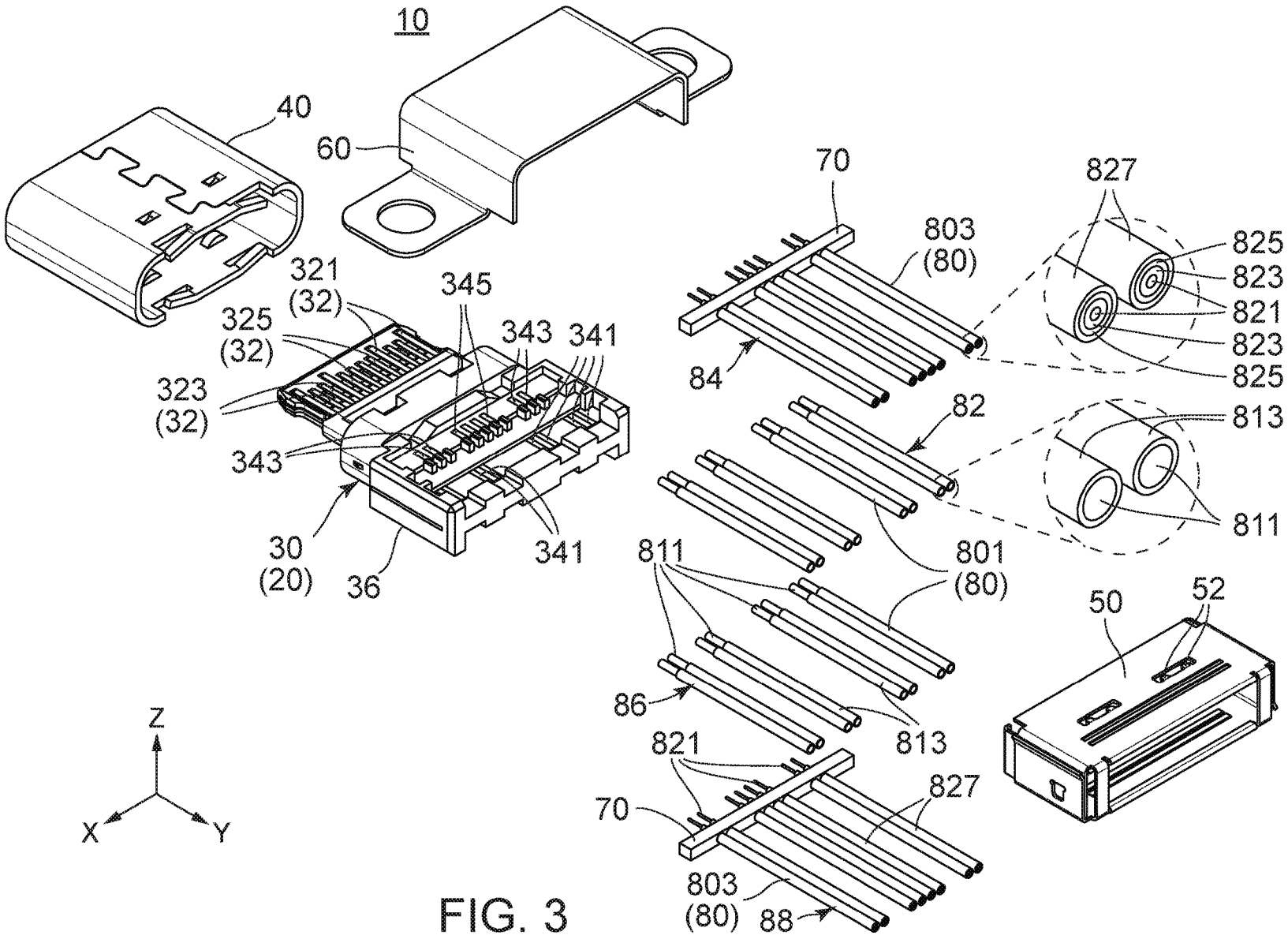
FIG. 3 is an exploded, perspective view showing the cable harness of FIG. 1. Cross sections of parts of cables are enlarged and illustrated.

Referring to FIG. 3, the connector 20 has a connector body 30, a front shell 40, a rear shell 50 and an attaching member 60. The front shell 40 is made of a metal sheet. The front shell 40 has a cylindrical shape, in a plane perpendicular to the front-rear direction, which has a cross-section of a rounded rectangular long in a pitch direction. The front shell 40 is attached to the connector body 30 to surround a front part of the connector body 30. In the present embodiment, the pitch direction is an X-direction perpendicular to the front-rear direction. The rear shell 50 is also made of a metal sheet. The rear shell 50 is attached to the connector body 30 in a state that its front part opens, and it is fixed to the connector body 30 by changing the front part thereof into a closed state. The rear shell 50 becomes a box shape in the closed state and surrounds a rear part of the connector body 30. The rear shell 50 is also connected to the front shell 40. The front shell 40 and the rear shell 50 are connected to each other to form a single shell. Although the front shell 40 and the rear shell 50 are distinct and separated from each other in the present embodiment, they may be formed in a single body. The attaching member 60 is made of a metal sheet and combined with the front shell 40 to cover the front shell 40 in part.

As shown in FIG. 3, the cable harness 10 further has a pair of ground bars 70. Each of the ground bars 70 holds part of the cables 80. In detail, the cables 80 are arranged in four rows in the pitch direction. The ground bars 70 hold the cables 80 belonging to two of the rows located outward in an up-down direction, i.e. the cables 80 of a second row 84 and the cables 80 of a fourth row 88, respectively. The cables 80 belonging to two of the rows located inward in the up-down direction, i.e. the cables 80 of a first row 82 and the cables 80 of a third row 86, are not held by the ground bars 70. In the present embodiment, the up-down direction is a Z-direction perpendicular to both of the front-rear direction and the up-down direction. A positive Z-direction is directed upward while a negative Z-direction is directed downward.

As shown in FIG. 3, the connector body 30 is provided with a plurality of terminals 32 and a holding member 36 holding the terminals 32. The terminals 32 are made of metal while the holding member 36 is made of insulating resin. The terminals 32 are integrally held by the holding member 36. In other words, the holding member 36 is integrally molded with the terminals 32. In the present embodiment, the terminals 32 are arranged in two rows; upper and lower rows. Hereinafter, referring to drawings, the description will be mainly made about the terminals 32 of the upper row and then simply made about the terminals 32 of the lower row.

Figure 4:
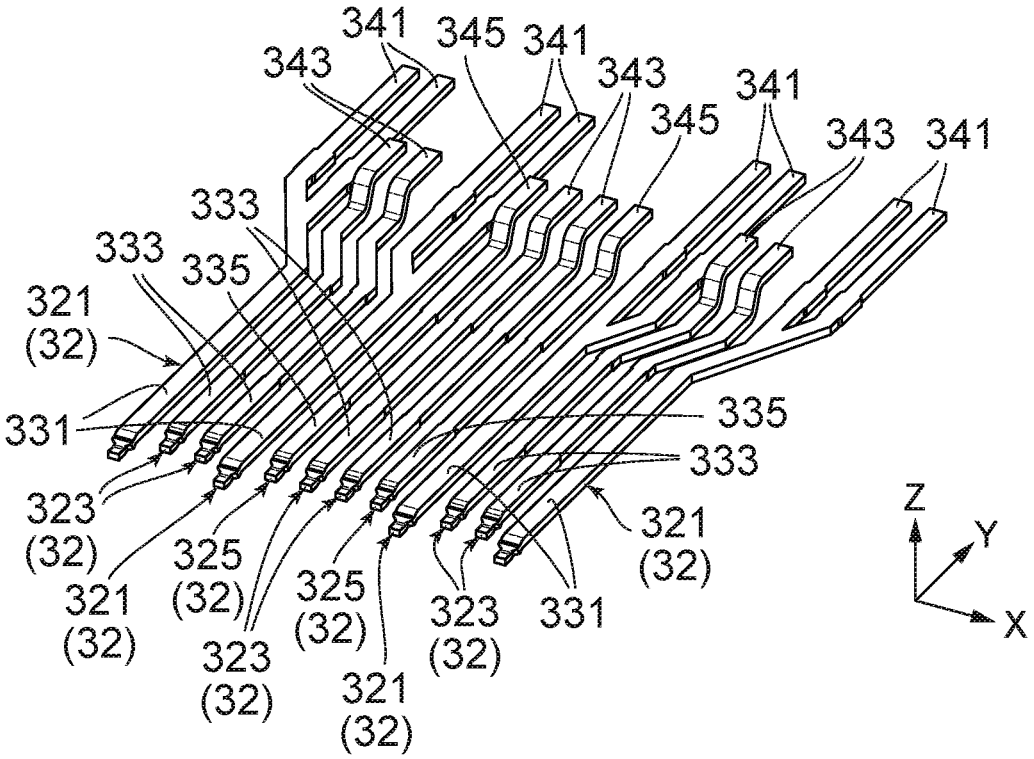
FIG. 4 is a perspective view showing terminals of an upper row provided to a connector body included in the cable harness of FIG. 3.
Figure 5:
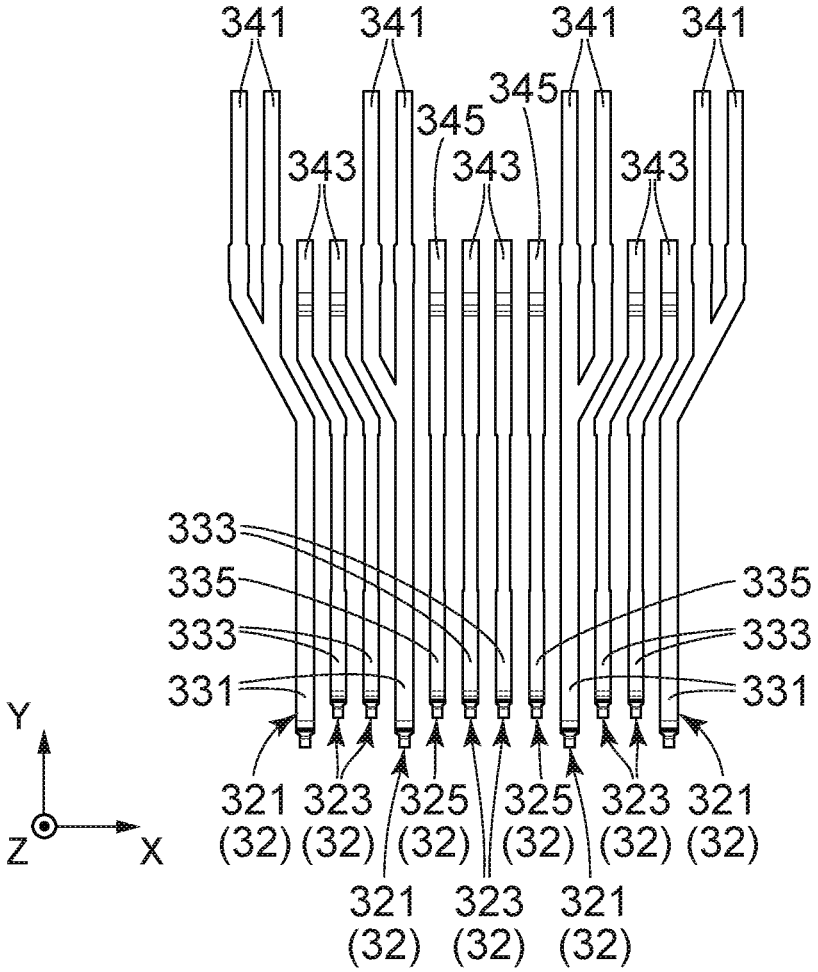
FIG. 5 is a plan view showing the terminals of the upper row of FIG. 4.
Figure 6:
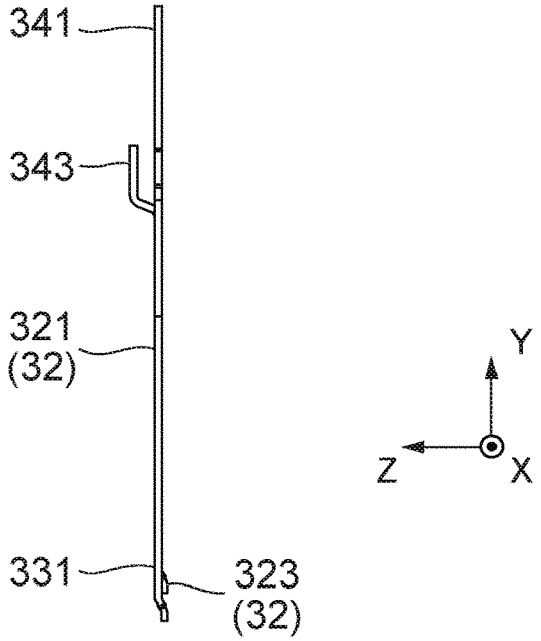
FIG. 6 is a side view showing the terminals of the upper row of FIG. 4.

Referring to FIGS. 4 to 6, the terminals 32 of the upper row are arranged in the pitch direction. The terminals 32 of the upper row include a plurality of first group terminals 321, a plurality of second group terminals 323 and at least one third group terminal 325. In the present embodiment, the first group terminals 321 are power supply terminals. The second group terminals 323 are high-speed signal terminals. The third group terminals 325 are low-speed signal terminals. Moreover, in the present embodiment, the first group terminals 321 are four in number. The second group terminals 323 are three pairs in number. The third group terminals 325 are two in number. However, in the present invention, the number of the terminals 32 is not limited thereto. It is adequate that at least two first group terminals 321 and a plurality of second group terminals 323 located between the first group terminals 321 are provided. In the present invention, the third group terminals 325 are not essential.

As shown in FIGS. 4 and 5, each of the terminals 32 has one contact portion (331, 333, 335) located near its front end and at least one wire connection portion (341, 343, 345) continuing to the contact portion. In detail, each of the first group terminals 321 has one first contact portion 331 and two first wire connection portions 341. Each of the second group terminals 323 has one second contact portion 333 and one second wire connection portion 343. Each of the third group terminals 325 has one third contact portion 335 and one third wire connection portion 345. Each of the first contact portions 331, the second contact portions 333 and the third contact portions 335 is a part brought into contact with the mating terminal (not shown) corresponding thereto when the connector 20 and the mating connector (not shown) are mated with each other. Strictly, since the mating connector may not have the corresponding mating terminal, each of the first contact portions 331, the second contact portions 333 and the third contact portions 335 is a part contactable with any one of the mating terminals. Each of the first wire connection portions 341, the second wire connection portions 343 and the third wire connection portions 345 is a part connectable to the cable 80. In the present embodiment, all of the first wire connection portions 341, the second wire connection portions 343 and the third wire connection portions 345 are connected to the cables 80. However, there is a case where one or more of the first wire connection portions 341, the second wire connection portions 343 and the third wire connection portions 345 are not connected to the cables 80 according to usage of the connector 20.

As understood from FIGS. 4 to 6, in the front-rear direction, a position of front ends of the first group terminals 321 is different from a position of front ends of the second group terminals 323 and the third group terminals 325. In the present embodiment, the position of the front ends of the first group terminals 321 is located forward of the position of the front ends of the second group terminals 323 and the third group terminals 325 in the front-rear direction. However, the present invention is not limited thereto. The position of the front ends of the first group terminals 321 and the position of the front ends of the second group terminals 323 and the third group terminals 325 may be identical with each other in the front-rear direction.

As shown in FIGS. 4 to 6, in the front-rear direction, the first contact portions 331, the second contact portions 333 and the third contact portions 335 are located forward of the first wire connection portions 341, the second wire connection portions 343 and the third wire connection portions 345, respectively. In addition, the first wire connection portions 341 are identical with the first contact portions 331 in the up-down direction. The second wire connection portions 343 and the third wire connection portions 345 are located upward of the second contact portions 333 and the third contact portions 335 in the up-down direction.

As understood from FIGS. 4 and 6, in the up-down direction, a position of the first contact portions 331 is identical with a position of the second contact portions 333 and the third contact portions 335. In addition, as understood from FIGS. 4 and 5, in the front-rear direction, a position of the first contact portions 331 overlaps with a position of the second contact portions 333 and the third contact portions 335. In other words, the first contact portions 331, the second contact portions 333 and the third contact portions 335 are arranged in the pitch direction. Between two of the first contact portions 331 adjacent to each other in the pitch direction among the first contact portions 331, at least two of the second contact portions 333 are located. In the present embodiment, between two of the first contact portions 331 adjacent to each other, two of the second contact portions 333 forming a pair are located.

As shown in FIG. 5, the first wire connection portions 341, the second wire connection portions 343 and the third wire connection portions 345 are different from one another in position projected on a plane defined by the front-rear direction and the pitch direction. In other words, when viewed along the up-down direction, the first wire connection portions 341, the second wire connection portions 343 and the third wire connection portions 345 are not overlapped with one another.

Figure 16:
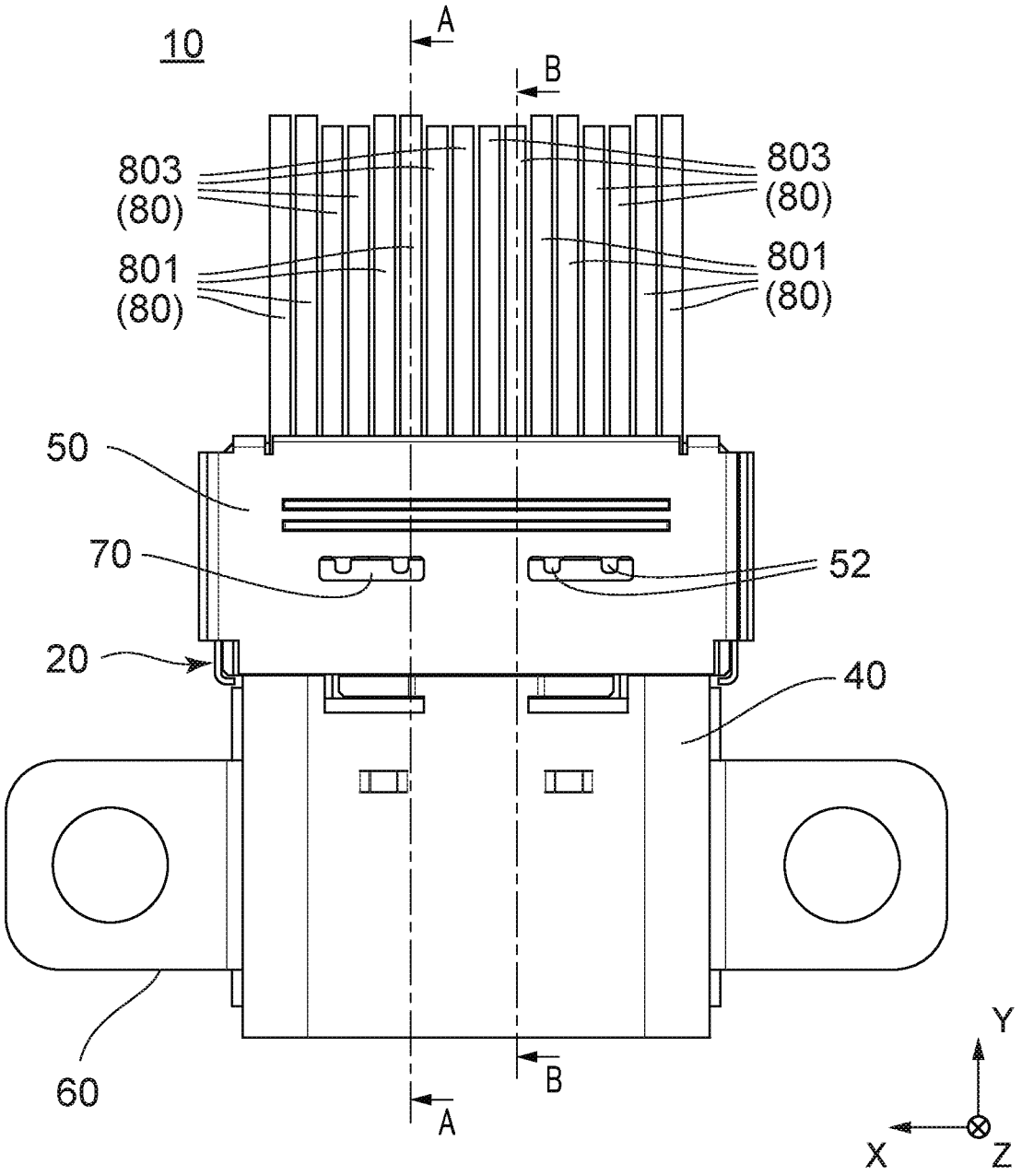
FIG. 16 is a bottom view showing the cable harness of FIG. 15.

As understood from FIGS. 4 to 6, positions of the first wire connection portions 341 are identical or approximately identical with each other in the front-rear direction and in the up-down direction. Similarly, positions of the second wire connection portions 343 and the third wire connection portions 345 are identical or approximately identical with one another in the front-rear direction and in the up-down direction. The positions of the first wire connection portions 341 are different from the positions of the second wire connection portions 343 and the third wire connection portions 345 in the front-rear direction and in the up-down direction. In the present embodiment, the second wire connection portions 343 and the third wire connection portions 345 are located forward of the first wire connection portions 341 in the front-rear direction and upward (outward) of the first wire connection portions 341 in the up-down direction. However, the present invention is not limited thereto. The second wire connection portions 343 and the third wire connection portions 345 may be located rearward of the first wire connection portions 341 in the front-rear direction and upward (outward) of the first wire connection portions 341 in the up-down direction. Alternatively, the first wire connection portions 341 may be located forward or rearward of the second wire connection portions 343 and the third wire connection portions 345 in the front-rear direction and upward (outward) of the second wire connection portions 343 and the third wire connection portions 345 in the up-down direction. At any rate, in the present invention, it is sufficient that one of a group of the first wire connection portions 341 and a group of the second wire connection portions 343 are located forward or rearward of the other group in the front-rear direction and outward of the other group in the up-down direction. However, it is preferable that the second wire connection portions 343 and the third wire connection portions 345 are located outward of the first wire connection portions 341 in the up-down direction in order to facilitate connection between the rear shell 50 and the ground bars 70 (see FIGS. 16 and 17). In the present embodiment, the position of the third wire connection portions 345 is identical with the position of the second wire connection portions 343 in the front-rear direction and in the up-down direction. However, the position of the third wire connection portions 345 may be identical with the position of the first wire connection portions 341 in the front-rear direction and in the up-down direction according to the cables 80 to be connected to them. It is noted that, in the present invention, an outward direction in the up-down direction depends on an attaching direction of the cables 80. In the present embodiment, the cables 80 are connected to upper surfaces of the first wire connection portions 341, the second wire connection portions 343 and the third wire connection portions 345 (see FIGS. 12 and 13). Accordingly, an upward direction is the outward direction in the up-down direction.

Figure 9:
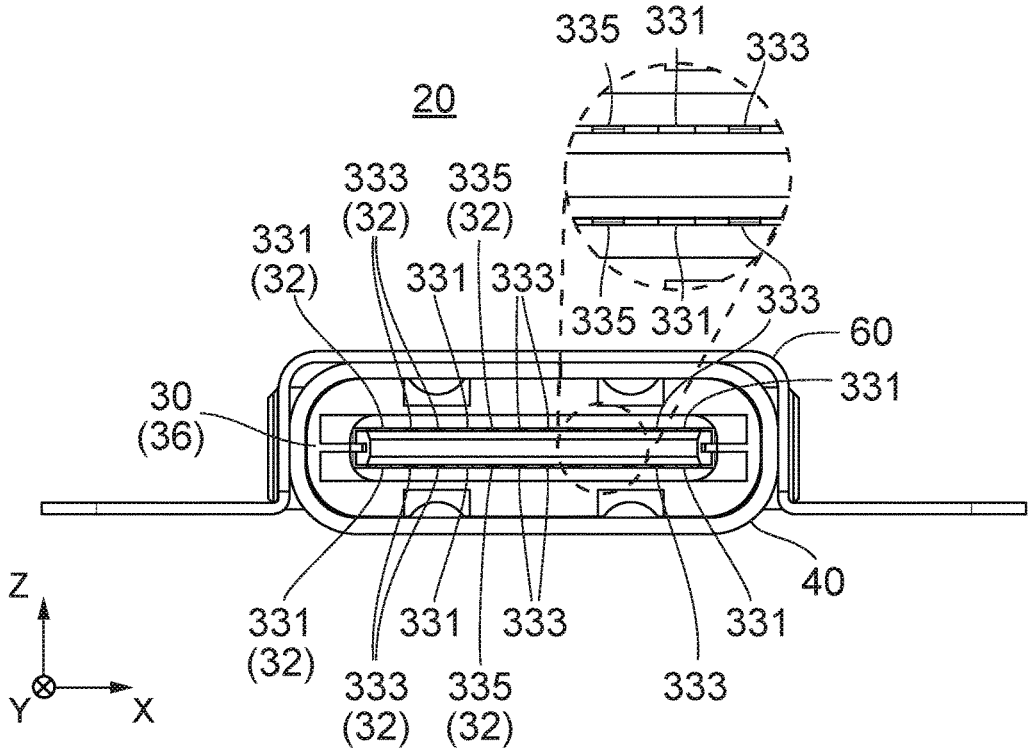
FIG. 9 is a front view showing the connector of FIG. 7. Parts of the terminals and the vicinity of them are enlarged and illustrated.

As understood from FIGS. 3 and 9, in the connector body 30, the first contact portions 331, the second contact portions 333 and the third contact portions 335 are exposed outside. In detail, the first contact portions 331, the second contact portions 333 and the third contact portions 335 of the terminals 32 of the upper row are exposed on an upper surface of a front part of the holding member 36. As shown in FIGS. 3, 7, 8 and 11, the first wire connection portions 341, the second wire connection portions 343 and the third wire connection portions 345 are also exposed outside the connector body 30. In detail, the first wire connection portions 341, the second wire connection portions 343 and the third wire connection portions 345 of the terminals 32 of the upper row are exposed upward in a rear part of the holding member 36.

The terminals 32 of the lower row are formed to the same structure as the terminals 32 of the upper row and arranged to be point symmetry to the terminals 32 of the upper row with respect to the middle in both of the up-down direction and the pitch direction. In other words, the connector 20 is a reversible connector which is insertable to a mating connector upside down, such as a USB Type-C connector.

Figure 7:
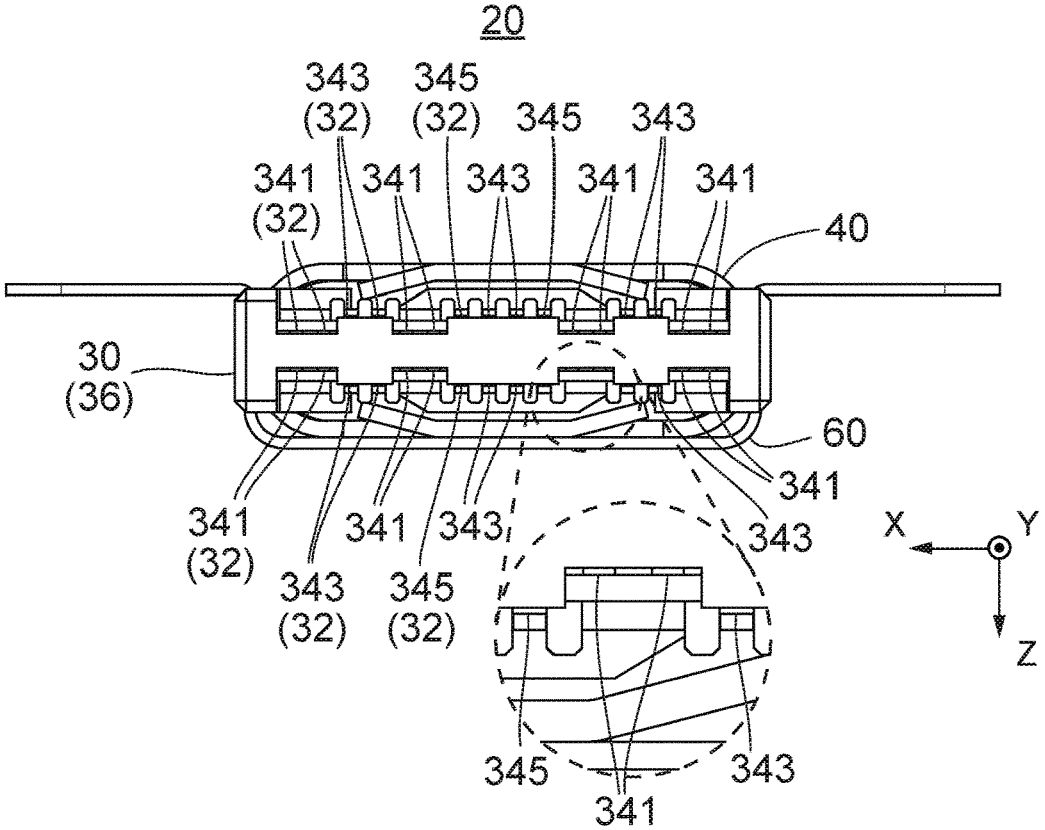
FIG. 7 is a rear view showing a connector included in the cable harness of FIG. 1. A rear shell is omitted. Parts of the terminals and the vicinity of them are enlarged and illustrated.
Figure 8:
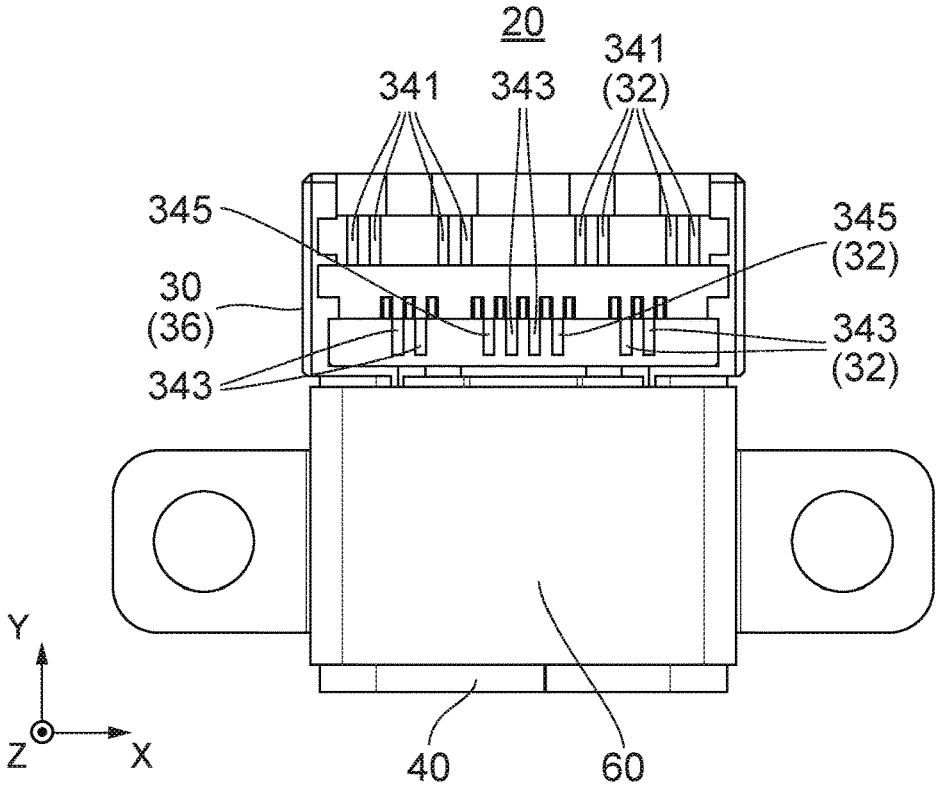
FIG. 8 is a plan view showing the connector of FIG. 7.
Figure 10:
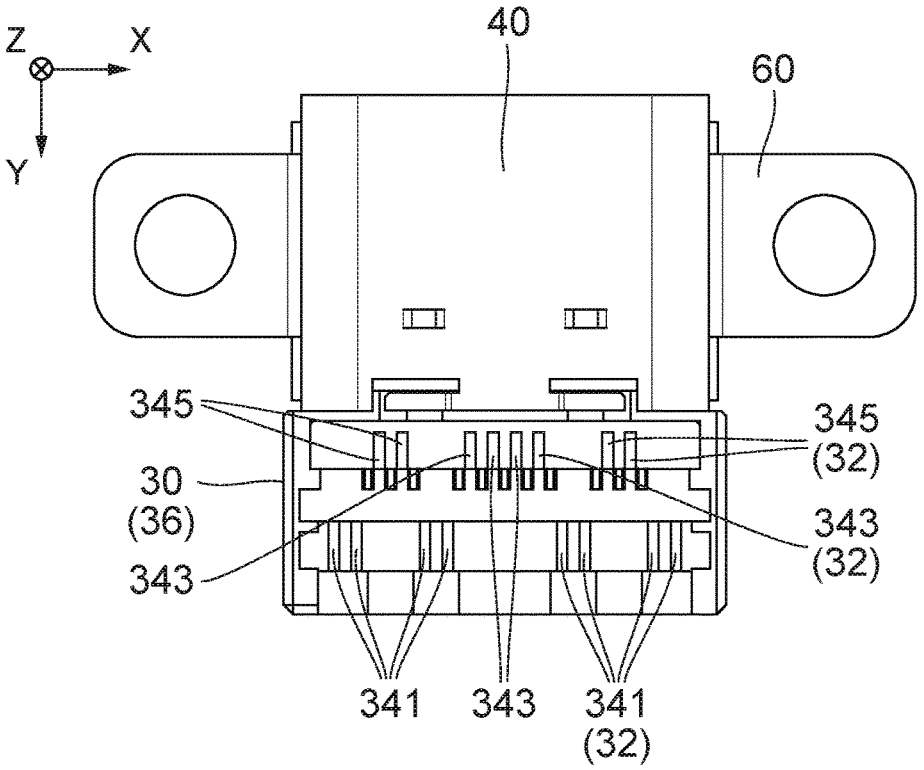
FIG. 10 is a bottom view showing the connector of FIG. 7.
Figure 11:
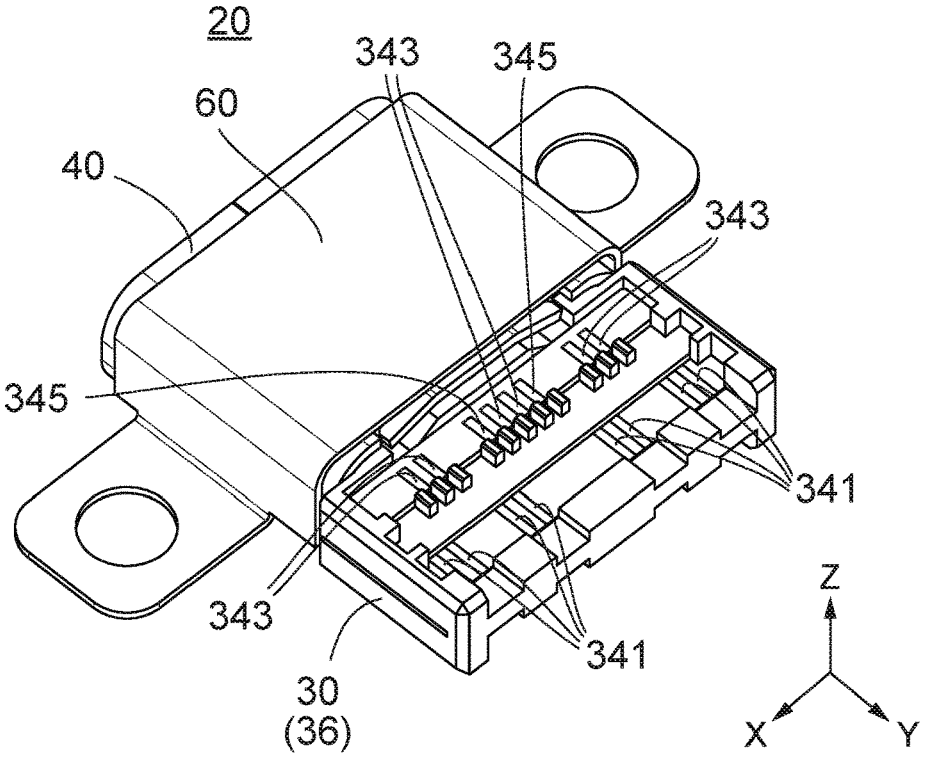
FIG. 11 is a perspective view showing the connector of FIG. 7.

As understood from FIGS. 7, 9 and 10, similar to the terminals 32 of the upper row, in the terminals 32 of the lower row, the first contact portions 331, the second contact portions 333, the third contact portions 335, the first wire connection portions 341, the second wire connection portions 343 and the third wire connection portions 345 are exposed outside the connector body 30. In detail, the first contact portions 331, the second contact portions 333 and the third contact portions 335 of the terminals 32 of the lower row are exposed on a lower surface of the front part of the holding member 36. The first wire connection portions 341, the second wire connection portions 343 and the third wire connection portions 345 are exposed downward in the rear part of the holding member 36.

Figure 15:
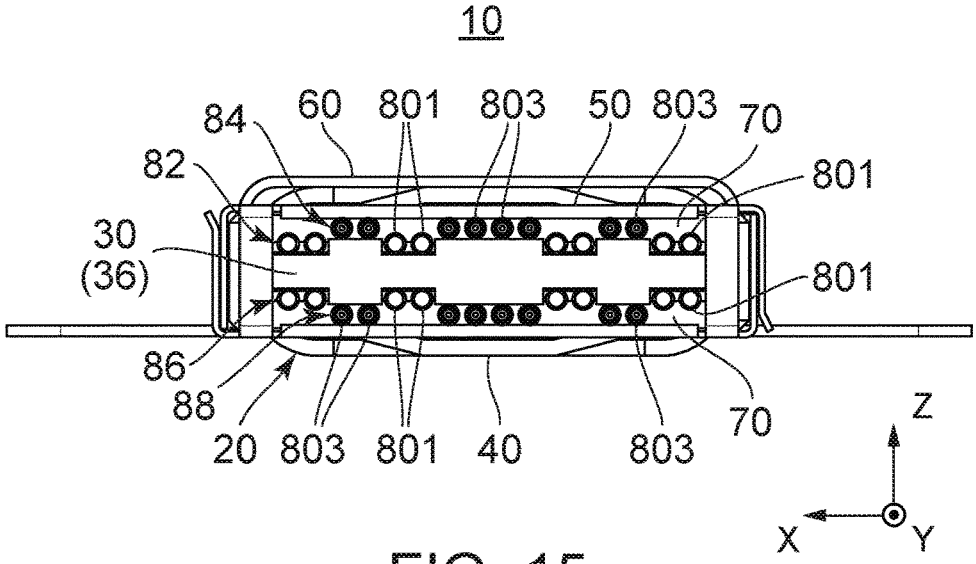
FIG. 15 is a rear view showing the cable harness of FIG. 1.

Referring to FIG. 15 in addition to FIG. 3, the cables 80 form the first row 82, the second row 84, the third row 86 and the fourth row 88 arranged in the up-down direction. The first row 82 and the second row 84, which are located at upper positions in the up-down direction, form an upper group. The third row 86 and the fourth row 88, which are located at lower positions in the up-down direction, form a lower group. The cables 80 of the upper group correspond to the terminals 32 of the upper row while the cables 80 of the lower group correspond to the terminals 32 of lower group. Each of the cables 80 of the first row 82 and the third row 86, which are located at inner positions in the up-down direction, is a first type cable 801. On the other hand, each of the cables 80 of the second row 84 and the fourth row 88, which are located at outer positions in the up-down direction, is a second type cable 803. In the present embodiment, the first type cables 801 are power supply lines while the second type cables 803 are signal lines. As understood from FIG. 15, the first type cables 801 and the second type cables 803 have an identical or approximately identical external diameter.

As expanded and illustrated in FIG. 3, in the present embodiment, each of the first type cables 801 has a conductor (or a first conductor portion) 811 and an outer sheath 813 covering the conductor 811. That is, in the present embodiment, the first type cables 801 are discrete wires. Moreover, in the present embodiment, each of the second type cables 803 has a central conductor (or a second conductor portion) 821, an insulator 823 surrounding the periphery of the central conductor 821, a shield portion 825 arranged around the insulator 823 and an outer sheath 827 covering them. That is, in the present embodiment, the second type cables 803 are thin coaxial cables. However, the present invention is not limited thereto. The first type cables 801 and the second type cables 803 may be cables having the same structure.

Figure 12:
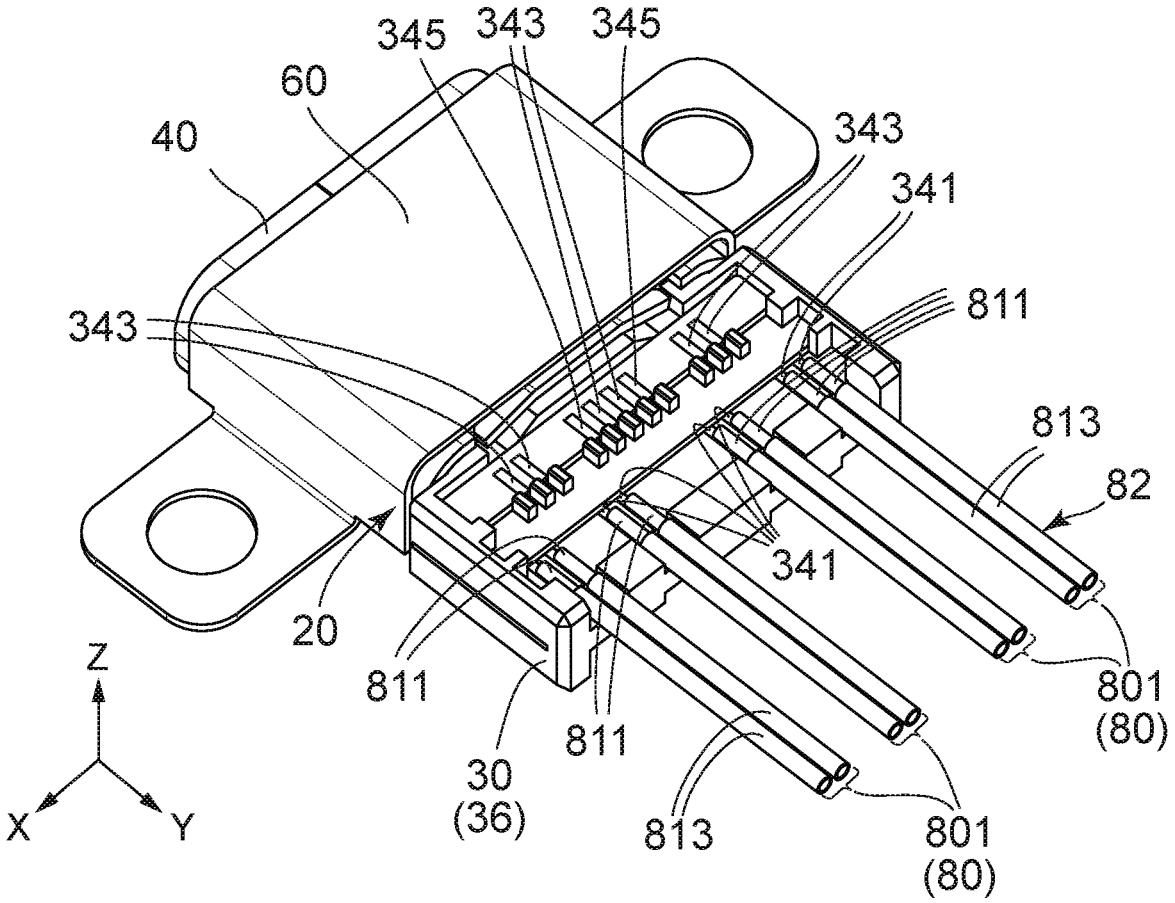
FIG. 12 is a perspective view showing the connector of FIG. 11 and cables of a first row connected to the connector.
Figure 14:
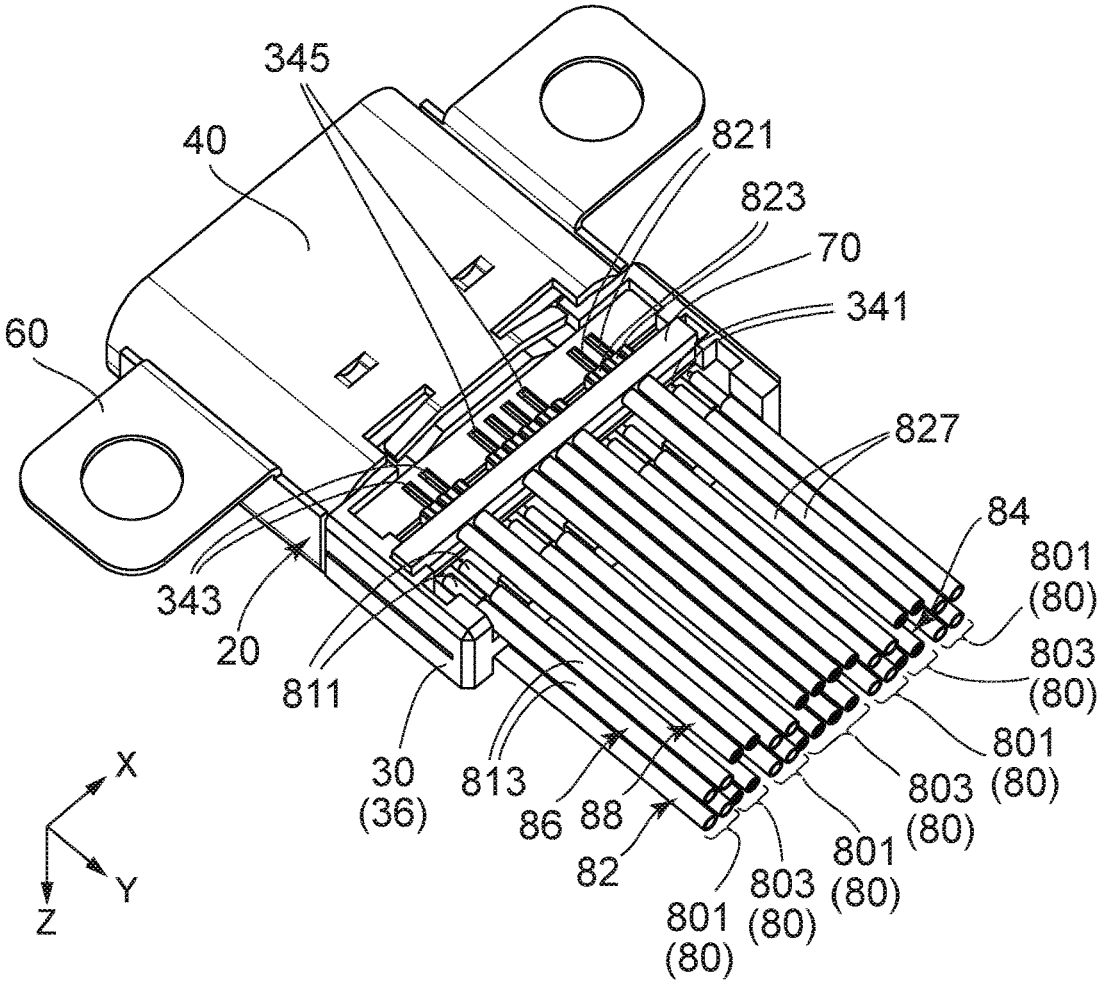
FIG. 14 is a perspective view showing the connector of FIG. 11 and cables of first through fourth rows connected to the connector.
Figure 17:
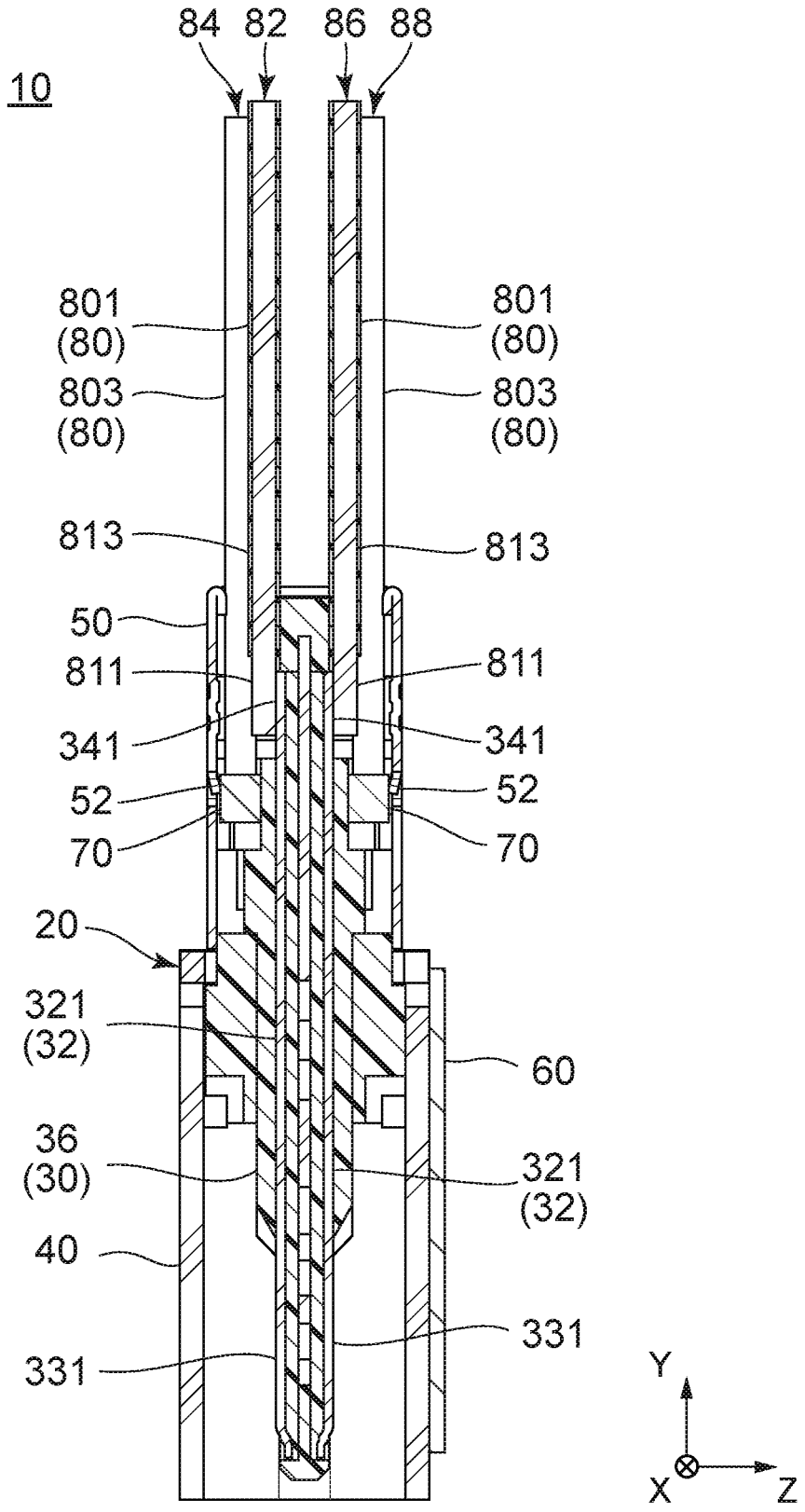
FIG. 17 is a cross-sectional view showing the cable harness of FIG. 16, taken along line A-A.

As shown in FIGS. 12 and 17, each of the first type cables 801 of the first row 82 is connected to any one of the first wire connection portions 341 of the terminals 32 of the upper row. In detail, the conductor 811 of each of the first type cables 801 of the first row 82 is connected to any one of the first wire connection portions 341 of the terminals 32 of the upper row. Similarly, as shown in FIG. 14, each of the first type cables 801 of the third row 86 is connected to any one of the first wire connection portions 341 of the terminals 32 of the lower row. Thus, each of the first group terminals 321 is connected to two of the first type cables 801. Accordingly, larger electric power can be supplied to each of the first group terminals 321 in comparison with a case where each of the first group terminals 321 is connected to one of the first type cables 801. In other words, according to the present embodiment, desired electric power can be supplied without employing power supply lines having larger external diameter than that of signal lines.

Figure 13:
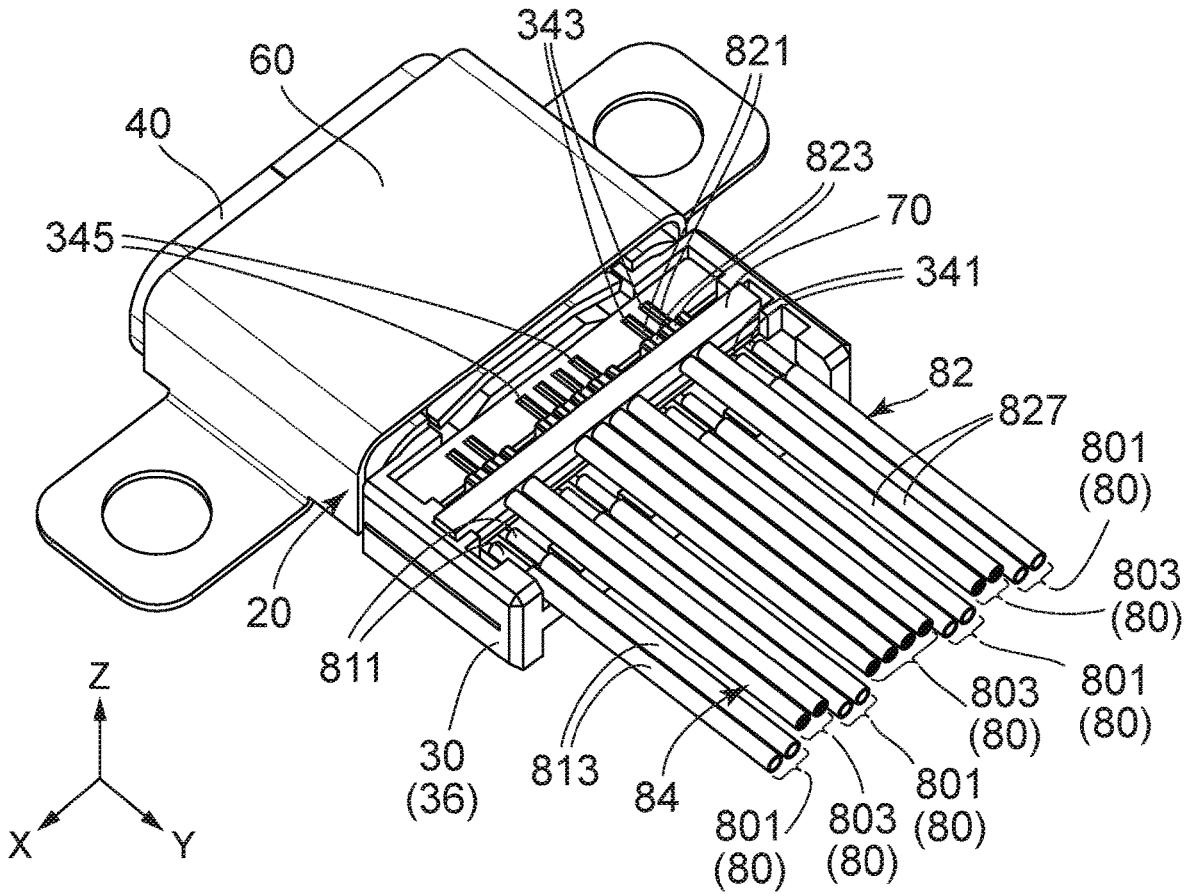
FIG. 13 is a perspective view showing the connector of FIG. 11 and cables of first and second rows connected to the connector.
Figure 18:
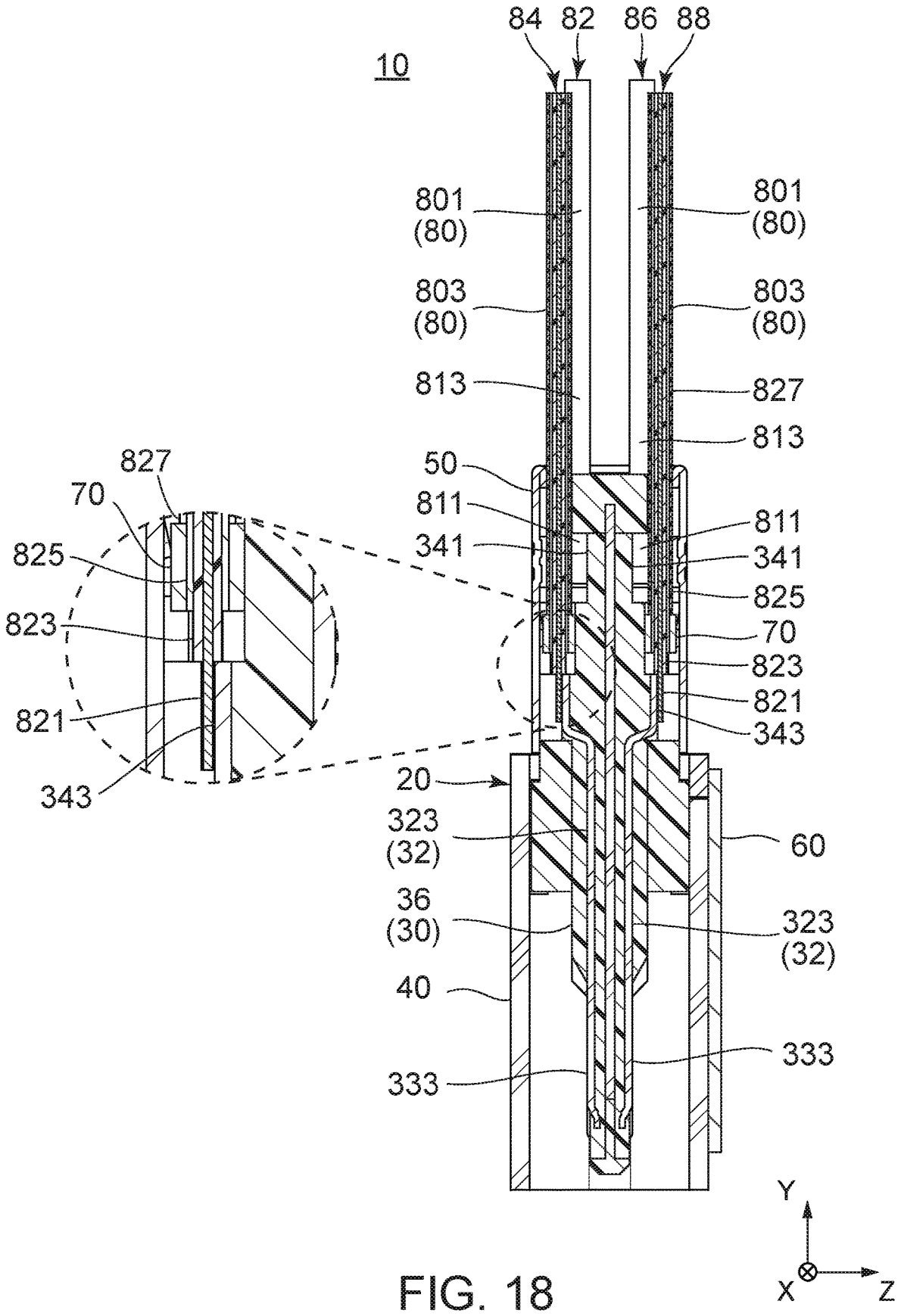
FIG. 18 is a cross-sectional view showing the cable harness of FIG. 16, taken along line B-B.

As shown in FIGS. 13 and 18, each of the second type cables 803 of the second row 84 is connected to any one of the second wire connection portions 343 and the third wire connection portions 345 of the terminals 32 of the upper row. In detail, the central conductor 821 of each of the second type cables 803 of the second row 84 is connected to one of the second wire connection portions 343 and the third wire connection portions 345 of the terminals 32 of the upper row. Similarly, as shown in FIG. 14, each of the second type cables 803 of the fourth row 88 is connected to one of the second wire connection portions 343 and the third wire connection portions 345 of the terminals 32 of the lower row. In the present embodiment, positions of the second wire connection portions 343 and the third wire connection portions 345 are different from positions of the first wire connection portions 341 in the front-rear direction and in the up-down direction. Therefore, for the terminals 32 arranged in the pitch direction, connection of the first type cables 801 to the first wire connection portions 341 and connection of the second type cables 803 to the second wire connection portions 343 and the third wire connection portions 345 can be carried out separately. In addition, it can be carried out that the second type cables 803 are held by the ground bars 70 while the first type cables 801 are not held by the ground bars 70. Thus, according to the present embodiment, connecting the first wire connection portion 341 and the second wire connection portion 343 to different type cables 80 can be carried out easily.

As shown in FIG. 13, the ground bar 70 holding the second type cables 803 of the second row 84 is accommodated, in part, in an accommodation portion formed on an upper surface side of the rear part of the holding member 36. Similarly, the ground bar 70 holding the second type cables 803 of the fourth row 88 is accommodated, in part, in an accommodation portion formed on a lower surface side of the rear part of the holding member 36. As shown in FIG. 18, each of the ground bars 70 holds the shield portions 825 of the second type cables 803 of the second row 84 or the fourth row 88. In other words, the shield portions 825 of the second type cables 803 of each of the second row 84 and the fourth row 88 are connected in common to the ground bar 70. As understood from FIGS. 16 and 17, each of the ground bars 70 is also connected to the rear shell 50 through connection portions 52 by any method such as soldering. Thus, the shield portions 825 of all of the second type cables 803 are maintained to the same electric potential (or the ground potential) as that of the rear shell 50.

Second Embodiment

Figure 19:
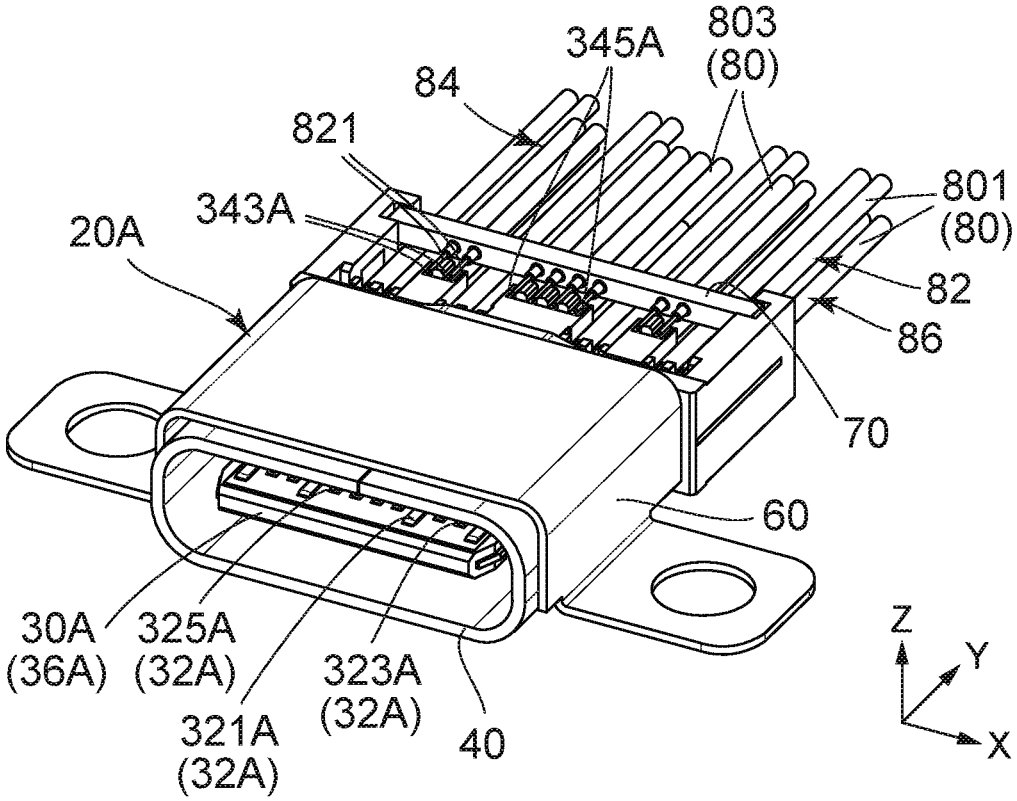
FIG. 19 is a perspective view showing a cable harness according to a second embodiment of the present invention. A rear shell is omitted.
Figure 20:
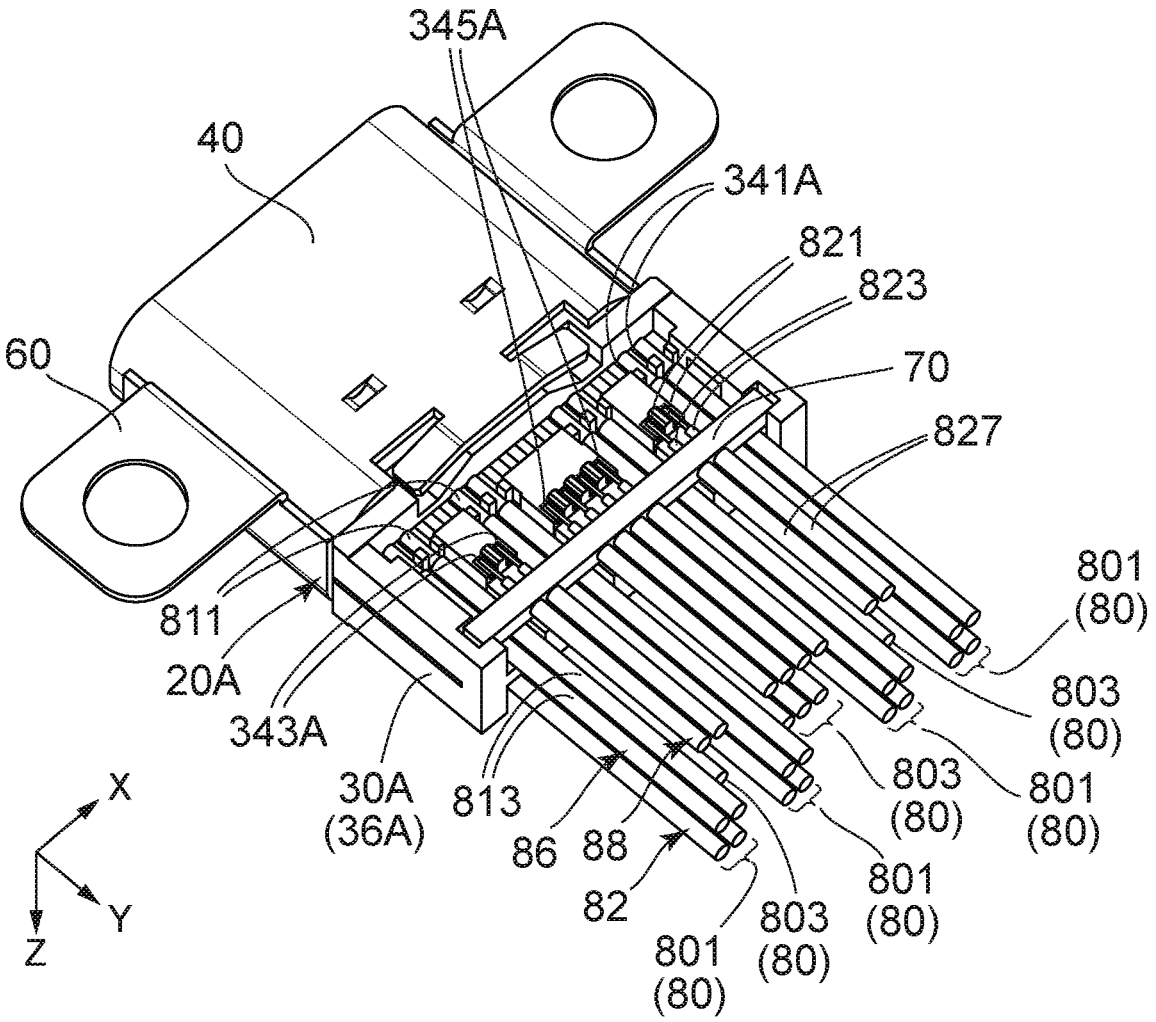
FIG. 20 is another perspective view showing the cable harness of FIG. 19.
Figure 21:
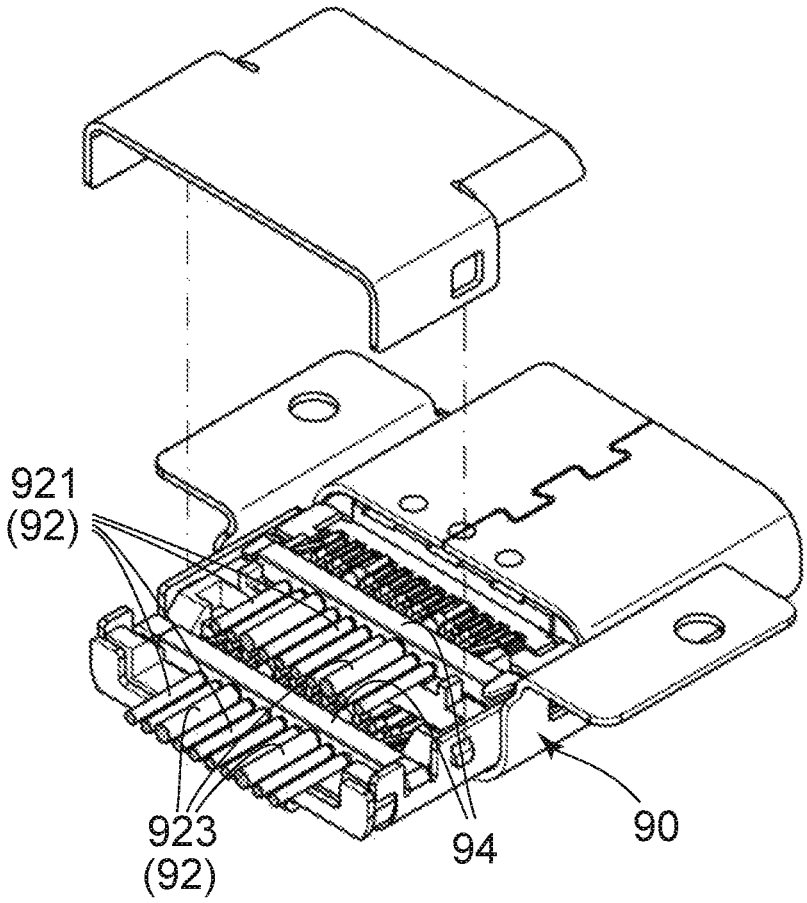
FIG. 21 PRIOR ART
FIG. 21 is an exploded, perspective view showing a connector described in Patent Document 1.

Referring to FIGS. 19 and 20, a cable harness according to a second embodiment of the present invention is provided with a connector 20A and the cables 80. The connector 20A is provided with a connector body 30A which has a plurality of terminals 32A and a holding member 36A holding the terminals 32A. Similar to the first embodiment, the terminals 32A are arranged in two rows; upper and lower rows. The terminals 32A of each row include first group terminals 321A, second group terminals 323A and third group terminals 325A. Each of the first group terminals 321A has a first contact portion (not shown) and first wire connection portions 341A. Similarly, each of the second group terminals 323A has a second contact portion (not shown) and a second wire connection portion 343A. Furthermore, each of the third group terminals 325A has a third contact portion (not shown) and a third wire connection portion 345A.

As understood from FIGS. 19 and 20, in each row of the terminals 32A, the second wire connection portions 343A and the third wire connection portions 345A are located rearward of the first wire connection portions 341A in the front-rear direction. In addition, in each row of the terminals 32A, the second wire connection portions 343A and the third wire connection portions 345A are located outward of the first wire connection portions 341A in the up-down direction. To each of the first wire connection portions 341A, the conductor 811 of the first type cable 801 is connected. To each of the second wire connection portions 343A and the third wire connection portions 345A, the central conductor 821 of the second type cable 803 held by the ground bar 70 is connected. Thus, also in the present embodiment, positions of the second wire connection portions 343A and the third wire connection portions 345A are different from positions of the first wire connection portions 341A in the front-rear direction and in the up-down direction. Accordingly, for the terminals 32A arranged in the pitch direction, connection of the first type cables 801 to the first wire connection portions 341A and connection of the second type cables 803 to the second wire connection portions 343A and the third wire connection portions 345A can be carried out separately. In addition, it can be carried out that the second type cables 803 are held by the ground bars 70 while the first type cables 801 are not held by the ground bars 70. Thus, according to the present embodiment, connecting the first wire connection portions 341A and the second wire connection portions 343A to different type cables 80 can be carried out easily.

Although the specific explanation about the present invention is made above referring to the embodiments, the present invention is not limited thereto. For example, although the connector 20 is the receptacle connector in the aforementioned embodiment, the present invention is applicable to a plug connector. In addition, although the terminals 32 are arranged in two rows of upper and lower rows, the terminals 32 may be arranged in one row. In other words, the present invention is applicable to a non-reversible connector. Furthermore, although the first type cable 801 and the second type cable 803 are different types in the aforementioned embodiment, they may be the same type.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a front-rear direction, wherein:

the connector comprises a plurality of first group terminals, a plurality of second group terminals, and a holding member holding the first group terminals and the second group terminals;

each of the first group terminals comprises one first contact portion and at least one first wire connection portion;

the first contact portion is contactable with a mating terminal when the connector and the mating connector are mated with each other;

the first wire connection portion is connectable to a cable;

the first contact portion is located forward of the first wire connection portion in the front-rear direction;

each of the second group terminals comprises one second contact portion and one second wire connection portion;

the second contact portion is contactable with a mating terminal when the connector and the mating connector are mated with each other;

the second wire connection portion is connectable to another cable;

the second contact portion is located forward of the second wire connection portion in the front-rear direction;

the first contact portions and the second contact portions are arranged in a pitch direction perpendicular to the front-rear direction;

two or more of the second contact portions are located between an adjacent two of the first contact portions in the pitch direction; and each of the first wire connection portions is located at a position different from a position of any of the second wire connection portions in the front-rear direction, in the pitch direction, and in an up-down direction perpendicular to both of the front-rear direction and the pitch direction.

2. The connector as recited in claim 1, wherein one of the first wire connection portion and the second wire connection portion is located forward of or rearward of a remaining one of them in the front-rear direction and outward of the remaining one in the up-down direction.

3. The connector as recited in claim 2, wherein the second wire connection portion is located forward of the first wire connection portion in the front-rear direction and outward of the first wire connection portion in the up-down direction.

4. The connector as recited in claim 2, wherein the second wire connection portion is located rearward of the first wire connection portion in the front-rear direction and outward of the first wire connection portion in the up-down direction.

5. The connector as recited in claim 1, wherein the first wire connection portion and the second wire connection portion are different from each other in position projected on a plane defined by the front-rear direction and the pitch direction.

6. The connector as recited in claim 1, wherein:

the connector further comprises at least one third group terminal;

the third group terminal comprises one third contact portion and one third wire connection portion;

the third contact portion is contactable with a mating terminal when the connector and the mating connector are mated with each other;

the third wire connection portion is connectable to yet another cable;

the third contact portion is located forward of the third wire connection portion in the front-rear direction; and the third wire connection portion is located at a position different from a position of the first wire connection portion in the front-rear direction and in the up-down direction.

7. The connector as recited in claim 1, wherein:

the connector comprises a receptacle connector while the mating connector comprises a plug connector;

the first group terminals have first front ends;

the second group terminals have second front ends; and the first front ends are located forward of the second front ends in the front-rear direction.

8. The connector as recited in claim 1, wherein the at least one first wire connection portion continuing to the one first contact portion comprises two first wire connection portions.

9. The connector as recited in claim 1, wherein:

the first group terminals and the second group terminals are arranged in upper and lower rows; and the first group terminals and the second group terminals belonging to the upper row and the first group terminals and the second group terminals belonging to the lower row are symmetrically arranged with respect to a middle of them in both of the up-down direction and the pitch direction.

10. A cable harness comprising a plurality of first type cables, a plurality of second type cables, a ground bar, and a connector mateable with a mating connector along a front-rear direction, wherein:

the connector comprises a plurality of first group terminals, a plurality of second group terminals, and a holding member holding the first group terminals and the second group terminals;

each of the first group terminals comprises one first contact portion and at least one first wire connection portion;

the first contact portion is contactable with a mating terminal when the connector and the mating connector are mated with each other;

the first wire connection portion is connectable to a cable;

the first contact portion is located forward of the first wire connection portion in the front-rear direction;

each of the second group terminals comprises one second contact portion and one second wire connection portion;

the second contact portion is contactable with a mating terminal when the connector and the mating connector are mated with each other;

the second wire connection portion is connectable to another cable;

the second contact portion is located forward of the second wire connection portion in the front-rear direction;

the first contact portions and the second contact portions are arranged in a pitch direction perpendicular to the front-rear direction;

two or more of the second contact portions are located between an adjacent two of the first contact portions in the pitch direction;

the first wire connection portion is located at a position different from a position of the second wire connection portion in the front-rear direction and in an up-down direction perpendicular to both of the front-rear direction and the pitch direction;

the connector further comprises a shell;

each of the first type cables comprises a first conductor portion;

the first conductor portion is connected to the first wire connection portion;

each of the second type cables comprises a second conductor portion and a shield portion;

the second conductor portion is connected to the second wire connection portion;

the second type cables are held by the ground bar;

the shield portion is connected to the ground bar; and the ground bar is connected to the shell.

11. A cable harness comprising a plurality of first type cables, a plurality of second type cables, a ground bar, and a connector mateable with a mating connector along a front-rear direction, wherein:

the connector comprises a plurality of first group terminals, a plurality of second group terminals, and a holding member holding the first group terminals and the second group terminals;

each of the first group terminals comprises one first contact portion and at least one first wire connection portion;

the first contact portion is contactable with a mating terminal when the connector and the mating connector are mated with each other;

the first wire connection portion is connectable to a cable;

the first contact portion is located forward of the first wire connection portion in the front-rear direction;

each of the second group terminals comprises one second contact portion and one second wire connection portion;

the second contact portion is contactable with a mating terminal when the connector and the mating connector are mated with each other;

the second wire connection portion is connectable to another cable;

the second contact portion is located forward of the second wire connection portion in the front-rear direction;

the first contact portions and the second contact portions are arranged in a pitch direction perpendicular to the front-rear direction;

two or more of the second contact portions are located between an adjacent two of the first contact portions in the pitch direction;

the first wire connection portion is located at a position different from a position of the second wire connection portion in the front-rear direction and in an up-down direction perpendicular to both of the front-rear direction and the pitch direction;

one of the first wire connection portion and the second wire connection portion is located forward of or rearward of a remaining one of them in the front-rear direction and outward of the remaining one in the up-down direction;

the second wire connection portion is located forward of the first wire connection portion in the front-rear direction and outward of the first wire connection portion in the up-down direction;

the connector further comprises a shell;

each of the first type cables comprises a discrete wire and has a first conductor portion;

the first conductor portion is connected to the first wire connection portion;

each of the second type cables comprises a thin coaxial cable and has a second conductor portion and a shield portion;

the second conductor portion is connected to the second wire connection portion;

the second type cables are held by the ground bar;

the first type cables are not held by the ground bar;

the shield portion is connected to the ground bar; and the ground bar is connected to the shell.

12. The cable harness as recited in claim 10, wherein:

the first type cables comprise power supply lines; and the second type cables comprise signal lines.

* * * * *